US005452667A

United States Patent [19]

Lim

[11] Patent Number: 5,452,667

[45] Date of Patent: Sep. 26, 1995

[54] PAPER PALLET

[76] Inventor: Chow P. Lim, 151 Jalan Kenanga, Taman Udajaya, Selangor Darul Ehsan, Malaysia, 68000

[21] Appl. No.: 149,510

[22] Filed: Nov. 9, 1993

[30] Foreign Application Priority Data

Nov. 18, 1992 [MY] Malaysia ..... PI 9202105

[51] Int. Cl.[6] ..... B65D 19/00

[52] U.S. Cl. ..... 108/51.3

[58] Field of Search ..... 108/51.3

[56] References Cited

U.S. PATENT DOCUMENTS

| | | | |
|---|---|---|---|
| 2,908,464 | 10/1959 | Traudt et al. | 108/51.3 |
| 2,925,947 | 2/1960 | Brown | 108/51.3 X |
| 2,928,578 | 3/1960 | Parker | 108/51.3 X |
| 3,308,772 | 3/1967 | Thomas, Jr. | 108/51.3 |
| 3,464,370 | 9/1969 | Martin | 108/51.3 |
| 3,601,067 | 8/1971 | Olsen | 108/51.3 |
| 3,763,791 | 10/1973 | Wilcox, Jr. | 108/51.3 |
| 3,861,326 | 1/1975 | Brown | 108/51.1 |
| 4,228,744 | 10/1980 | Moore | 108/51.3 |
| 4,467,728 | 8/1984 | Horne | 108/51.3 X |
| 4,875,419 | 10/1989 | Helton et al. | 108/51.3 X |
| 4,966,084 | 10/1990 | Motomaru | 108/51.3 |
| 5,176,090 | 1/1993 | Roberts et al. | 108/51.3 |
| 5,195,440 | 3/1993 | Gottlieb | 108/51.3 |

FOREIGN PATENT DOCUMENTS 0183140 11/1985 European Pat. Off. .

*Primary Examiner*—James R. Brittain
*Assistant Examiner*—Robert J. Sandy
*Attorney, Agent, or Firm*—Townsend and Townsend and Crew

[57] ABSTRACT

There is disclosed a paper pallet comprising of a first sheet 10, a second sheet 20 and support means 30, wherein the support means 30 is part of the first sheet 10 and second sheet 20 formed by cutting, creasing, folding and securing tongues 35, 37. The tongue 35 intersects at a 90 degree angle with the tongue 37 and a flange 32 is secured to the slot 34 which forms "slot in" locking means. The strength of the present invention can be further increased by adding a reinforcement core 36 to the inside of the hollow space within the support means 30 or alternatively the reinforcement core 36 may enclose the fastened tongues 35, 37 to form the support means 30. The invention can be varied in dimension, height and numbers of the support means 30.

11 Claims, 7 Drawing Sheets

PAPER PALLET

This invention relates to paper pallets for supporting cargoes during transportation, shipment and storage.

A pallet is an apparatus widely used to transport cargoes from one place to another. The idea of a pallet is to facilitate cargo shipment or delivery in an easy and safe manner. There are a wide range of pallets with different types and functions according to the type of cargoes to be transported. Paper pallets have long been used for the transportation and storage of various merchandise.

Lately, such pallet structures have become increasingly sophisticated to meet varying standards and demands. In the past, pallets have commonly been constructed from a rigid material namely wood. Such pallets, however, are relatively heavy, bulky and expensive. Therefore in general all paper materials are much more suitable and cheaper for the construction of such pallets. Furthermore, in wooden pallets, all the parts are interconnected by adhesive substances, nails or metal wire stitches that pose as great disadvantages during the recycling process. Because of their separate components, such pallets can be very heavy and expensive.

It is an object of the invention to seek to overcome these disadvantages.

Thus according to a first aspect of the invention there is provided a pallet comprising a first sheet member and a second sheet member and a plurality of support means, characterised by the support means comprising interengageable tongues extending substantially out of the plane of said sheet members and comprising mutually cooperating means.

It is preferred that the interengageable tongues comprise a body and a plurality of fingers, and that said fingers extend substantially the length of said body. The fingers may themselves be substantially rectangular or triangular in shape, and may also have tapered ends.

It is further preferred that the support means may comprise securing means. This may be in the form of at least one of said tongues comprising a slot or notch and at least one other of said fingers comprising a flange disposed to engage the slot or notch. The slot or notch may reside in the body of said at least one tongue, and the flange may extend substantially out of the plane of the fingers.

The pallets of the invention may comprise a reinforcing member or members, which may be disposed around and/or within at least one of said plurality of support means.

It is preferred that the pallets of the invention and the reinforcing means for them comprise corrugated fibreboard and/or paperboard or any other suitable material, and they may be treated with a water resistant coating.

According to a second aspect of the invention there is provided a kit for assembly of a pallet comprising a first sheet member and a second sheet member and a plurality of support means, characterised by the support means comprising interengageable tongues extending substantially out of the plane of said sheet members upon erection and comprising mutually cooperating means. Such kits may be transported and stored in "flat packed" form for convenience.

The principle object of the present invention is thus to have a pallet which may consist of the very fewest parts and yet may retain the same configuration, rigidity and strength of existing wooden or paper pallets. This object is achieved in the present invention as the support means which may be seen as multiple inner legs are part of the upper and lower sheets cut, creased, folded and secured by a "slot in" locking means.

A further object of the present invention is to have an easily assembled pallet where each part of it is joined and secured by way of "slot in" locking means without using any added materials such as glue, nails, metal wire stitches or any other adhesive substance.

A further object of the present invention is to provide pallets that are environmentally friendly and easily recycled. This object is achieved as biodegradable materials to be used are for example corrugated fibreboard, solid paperboard or any other suitable material. Furthermore, the present invention may be made up entirely of paper material without the use of any adhesive substance, nails or metal wire stitches so that there is no difficulty in sorting out materials for recycling.

A further object of the present invention is to provide a space saving pallet which is easily transported and distributed. This object is achieved as the present invention may be delivered as a flat corrugated fibreboard or solid paperboard. These materials are also very light in weight so that tremendous saving can be achieved in the cost of transportation or distribution especially when using airfreight cargo.

A still further object of the present invention is to provide such a pallet that is variable in size and yet has the configuration of an ordinary pallet so that lifting and moving the pallet with cargo can be done by an ordinary forklift truck. Thus avoiding unnecessary modification on the forklift truck. Unlike the conventional pallets, all of which have nine legs, the number of legs in the present invention can be varied according to the size of the invention.

The present invention may comprise an upper and lower sheet and multiple inner legs to give a strong and ideal support for cargoes. The upper sheet and lower sheet are joined together by means of inner legs. These inner legs are locked together by way of "slot in" locking means so that a perfect pallet can be constructed.

The present invention can be coated or impregnated with wax or chemical in order to make it water resistant.

The present invention will become more fully understood from the detailed description given hereinbelow, by way of examples of the preferred embodiment of a paper pallet made in accordance with the present invention. Reference will be made to the accompanying drawings in which.

Figure 4A:
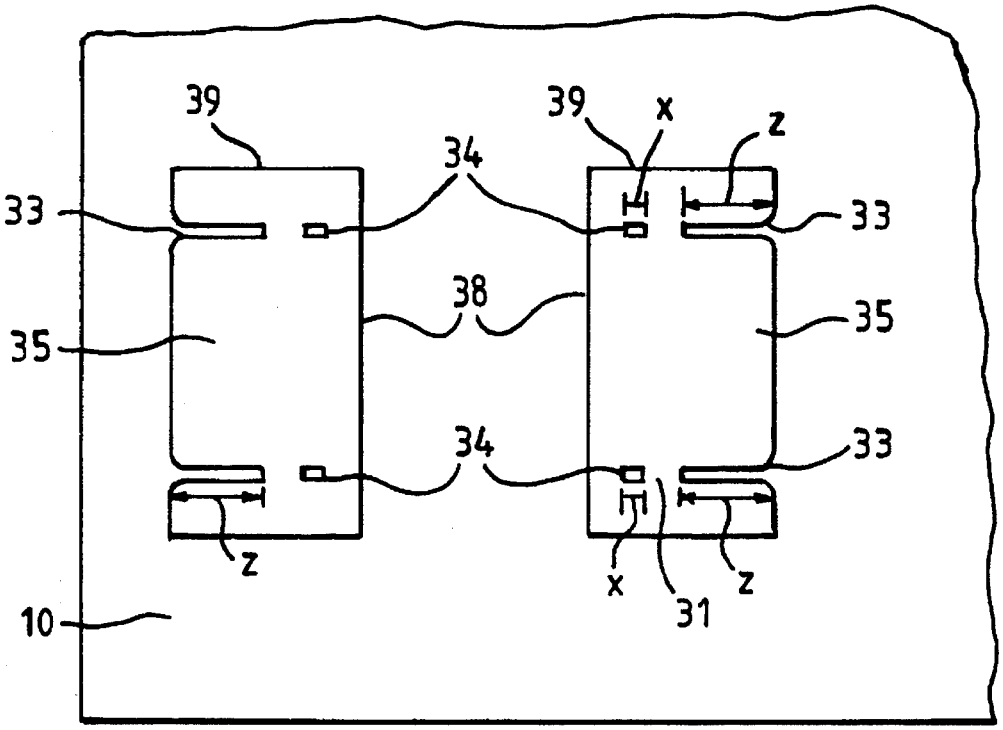
Figure 4B:
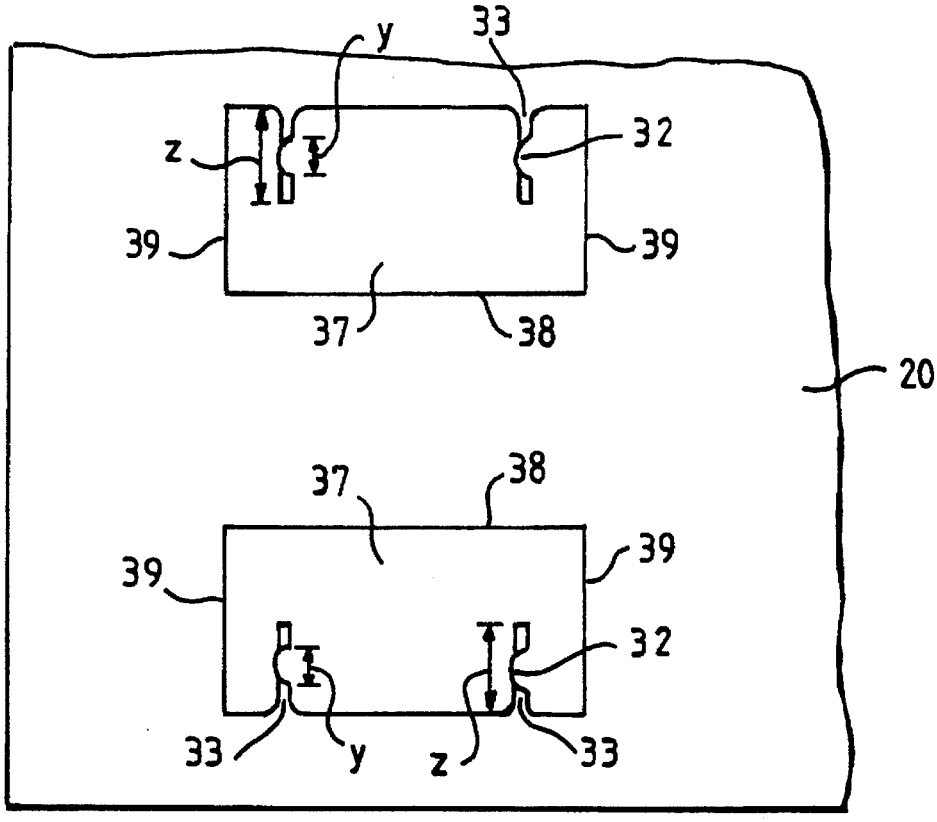
Figure 5A:
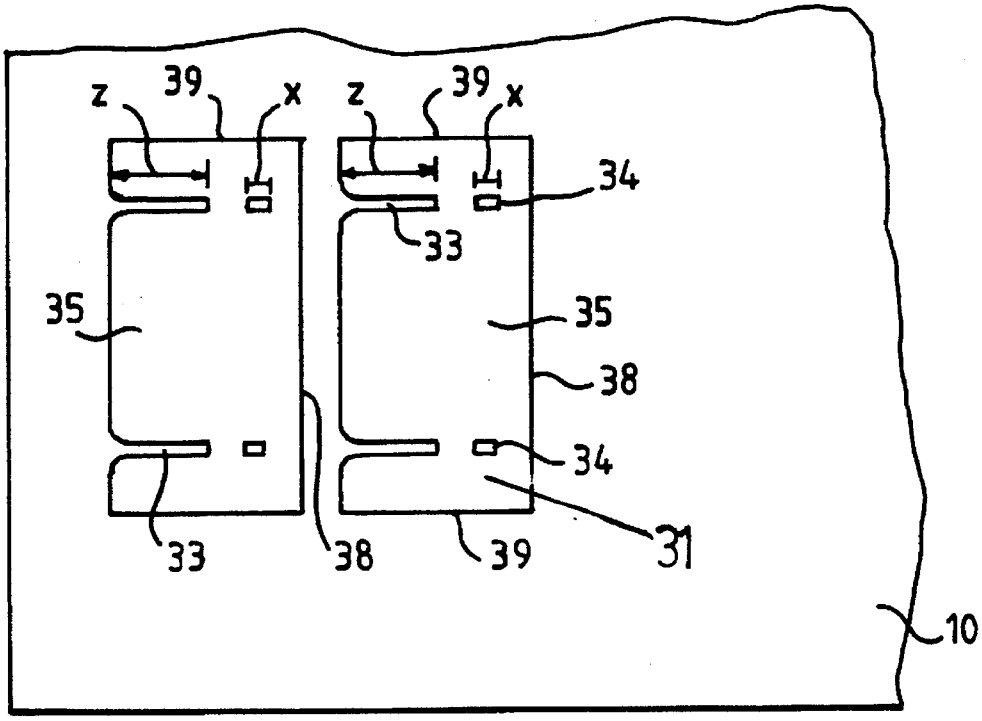
Figure 5B:
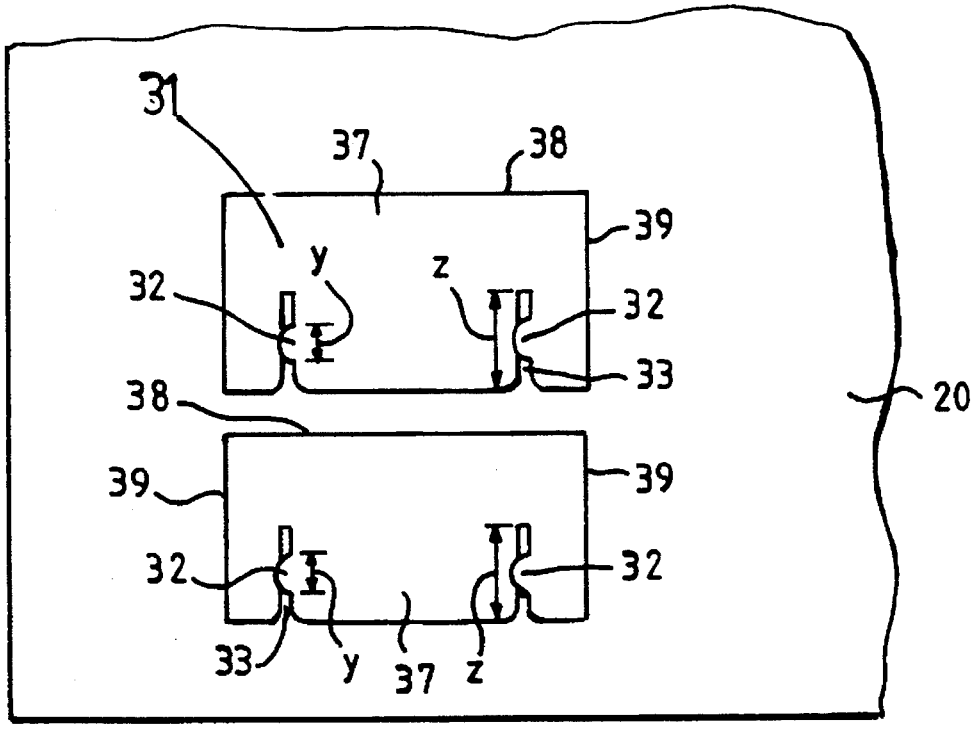
Figure 6:
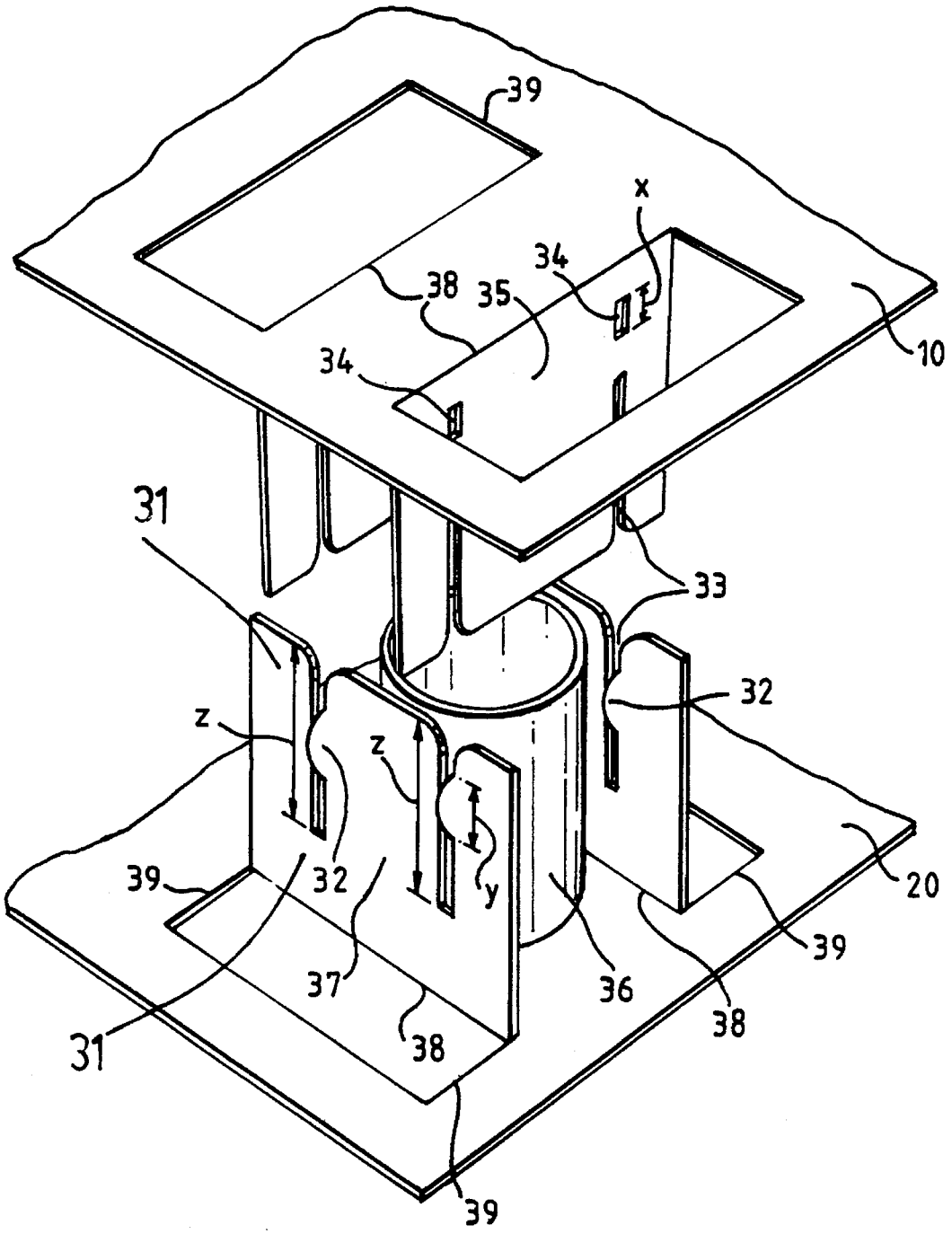
Figure 7:
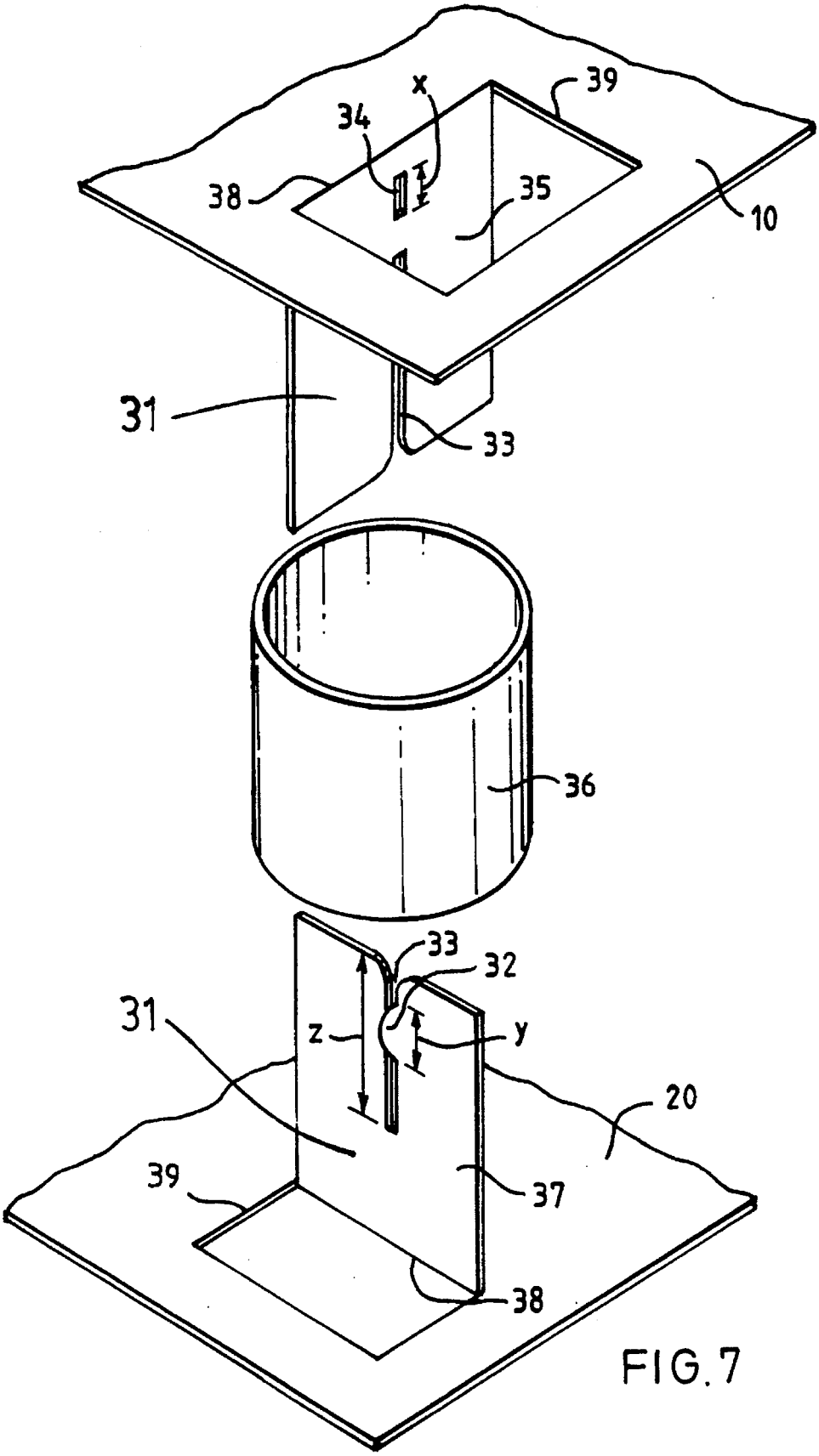
Figure 8A:
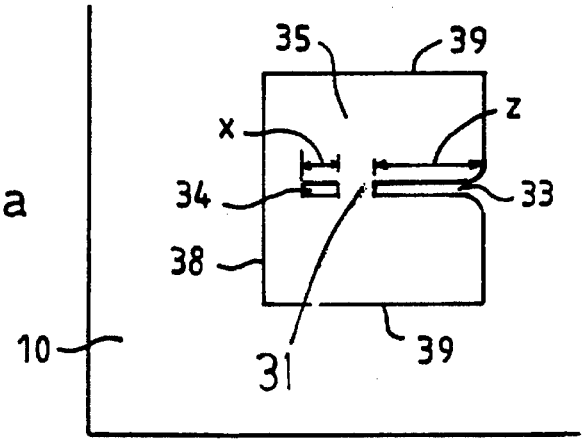
Figure 8B:
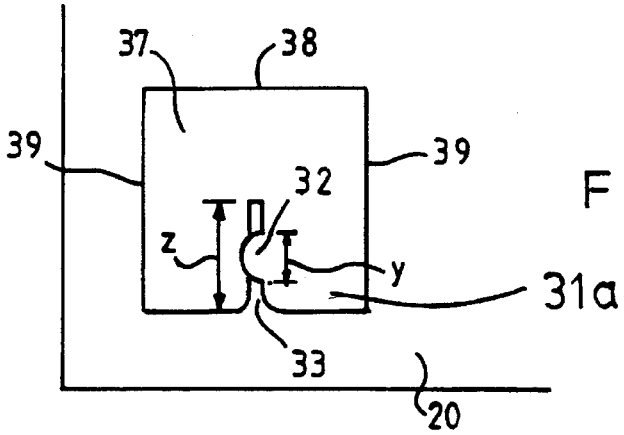
Figure 9:
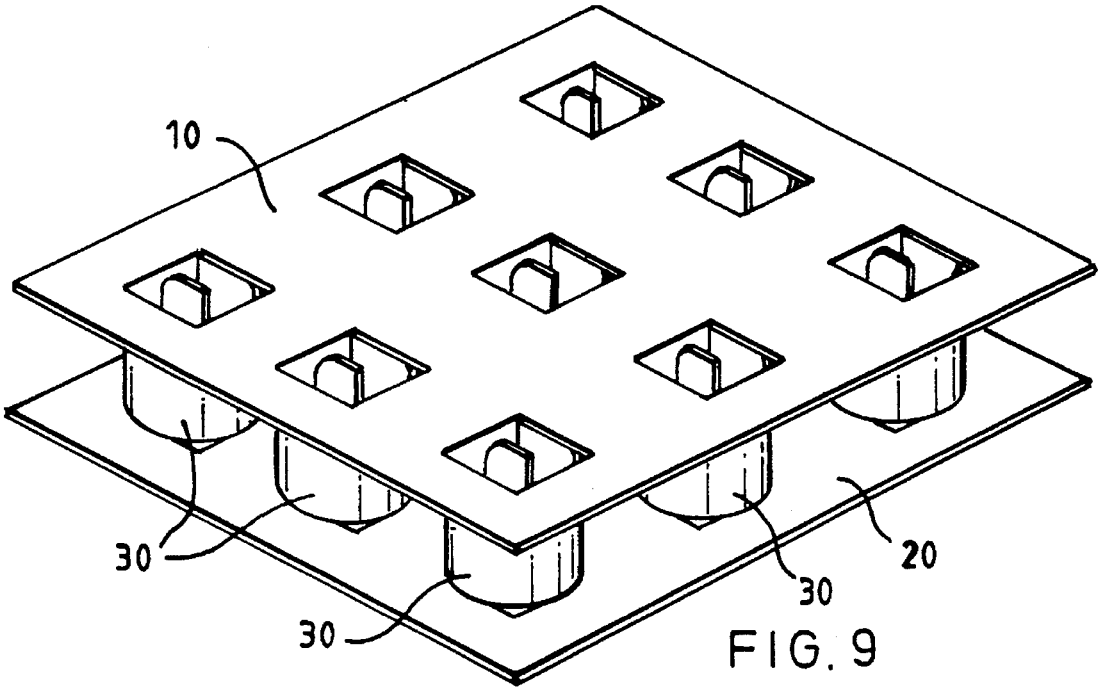

FIG. 4*a* shows a plan view of cut lines and crease lines to form one of the tongues of the upper sheet;

FIG. 4*b* shows cut lines and crease lines to form one of the tongues of the lower sheet;

FIGS. 5*a* and 5*b* show an alternative cutting arrangement for the tongues of the upper and lower sheets;

FIG. 6 shows a reinforcement core placed inside the support and securing means;

FIG. 7 shows an exploded view of an alternative arrangement for a reinforcement element for the support and securing means;

FIGS. 8*a* and 8*b* show in detail a plan view of the tongues 35 and 37 of an alternative embodiment; and FIG. 9 shows the assembled alternative embodiment of the present invention with the reinforcement cores being disposed outside the support and securing means.

Figure 1:
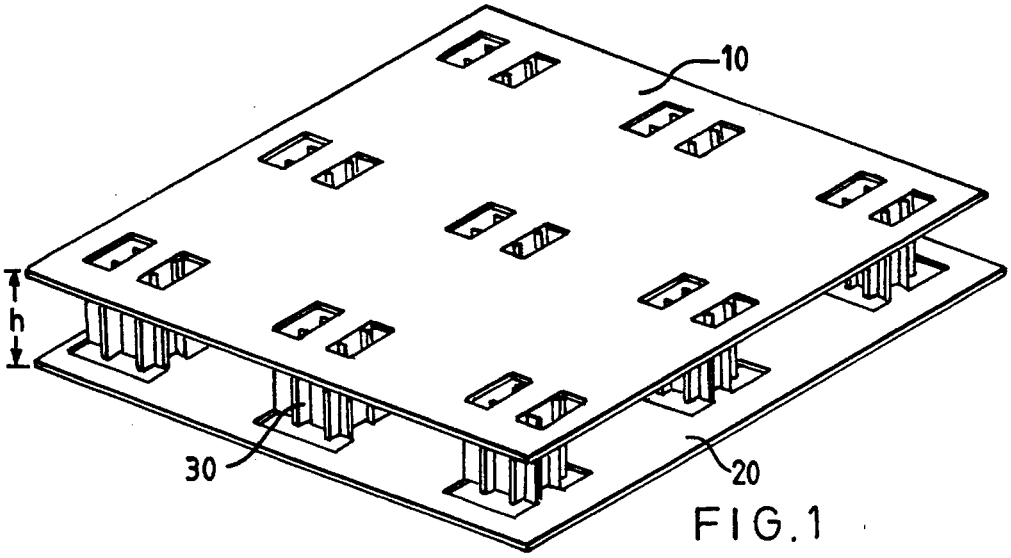
FIG. 1 shows an assembled paper pallet of the present invention.
Figure 2:
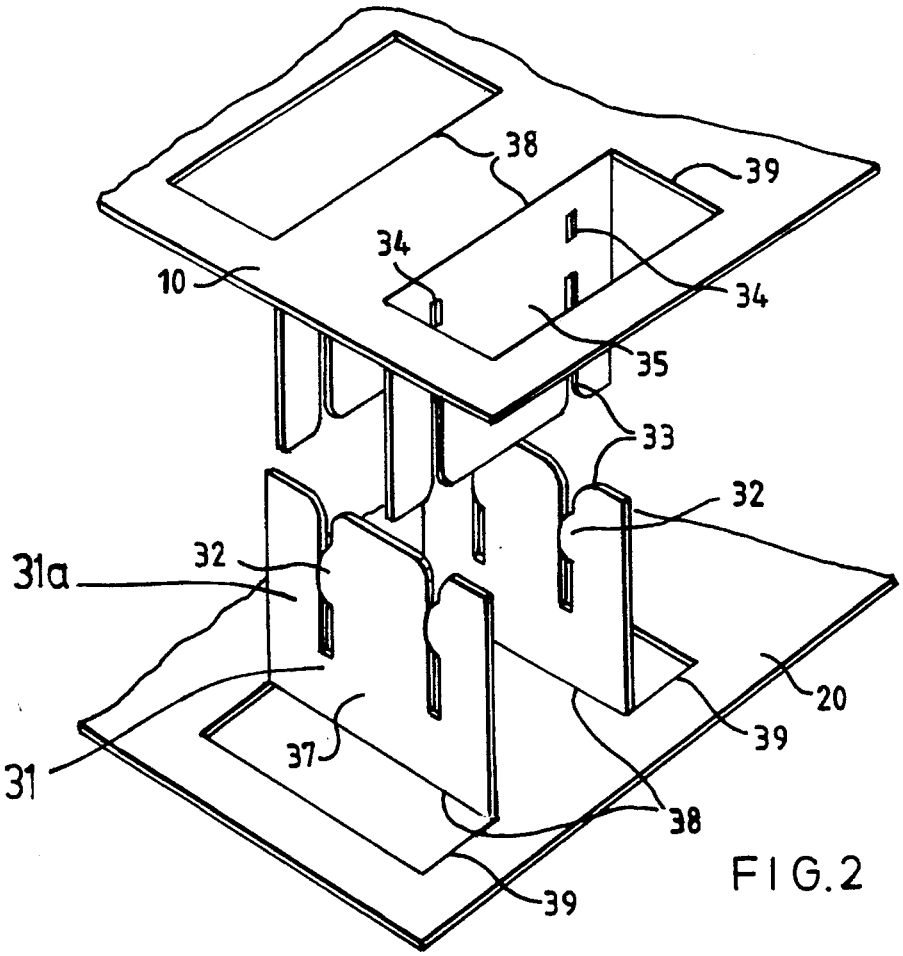
FIG. 2 illustrates an exploded view of the support and securing means.

Referring to FIGS. 1 and 2, the present invention mainly comprises a first sheet 10, a second sheet 20 and support means 30. The said support means 30 are formed by cutting, creasing and folding parts of the first sheet 10 namely the tongue 35 and second sheet 20 namely the tongue 37 and the said tongues 35, 37 are secured by a simple "slot in" locking means. The first sheet's tongue 35 is folded downward (as viewed) at the crease line 38 perpendicular to the said first sheet 10, and the second sheet's tongue 37 is folded upward (as viewed) at the crease line 38 perpendicular to said second sheet 20. Thus the two tongues 35 and 37 will be assembled in an erected mode to form the said support means 30. The first sheet 10 and second sheet 20 surfaces are flat so as to properly place and support the cargoes which are to be transported in an easy and safe manner.

FIG. 2 shows an exploded view of one of the support means 30 with the "slot in" locking means. The locking means may comprise securing means comprising an extended flange 32 which is part of the tongue 37 and is secured to the slots 34 to form a simple yet perfect "slot in" locking means. When all the flanges 32 of the tongues 37 are secured to the slots 34 of the tongues 35 they will form the said support means 30 which will stand firmly and hence provide substantially better support and rigidity to the cargoes which will be placed on top of the said paper pallet.

Figure 3:
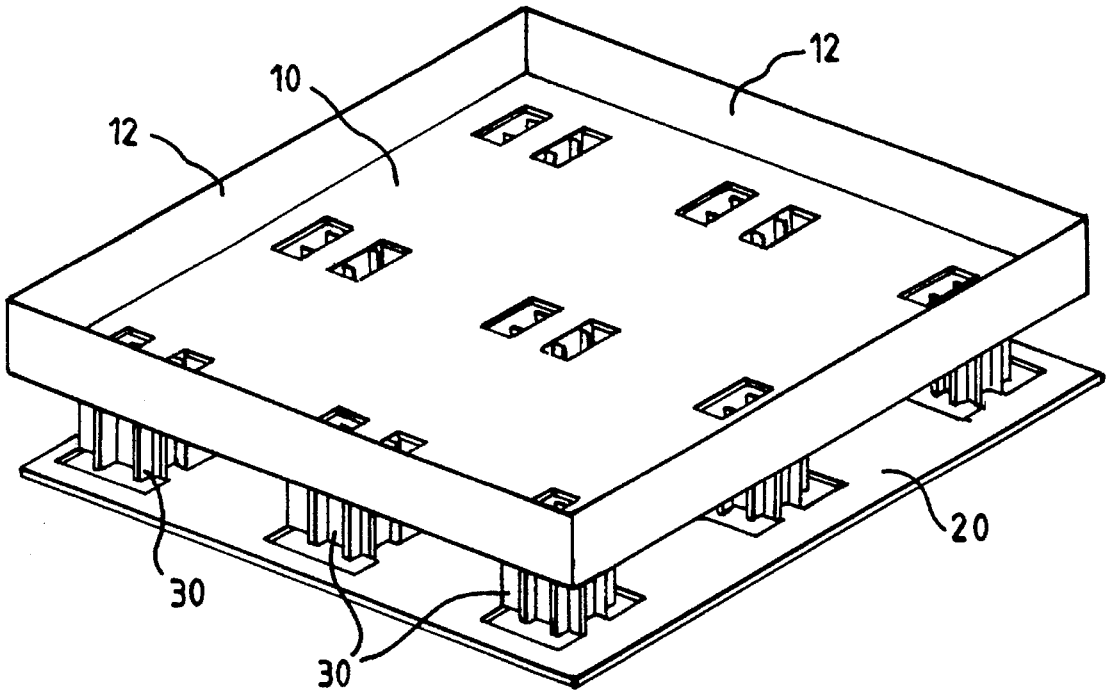
FIG. 3 shows an assembled paper pallet with side walls.

The first sheet 10 may also be extended on all four edges so that it can be folded up to form side walls 12 as illustrated in FIG. 3. The corners of the side walls 12 are secured to each other by a suitable method. The side walls 12 protect the cargoes from sliding down from the pallet.

Referring to FIGS. 1, 4*a*, 4*b*, 5*a* and 5*b*, the height (h) of the pallets embodying the invention may be determined by the length of the cut line 39 which may be the same length for all the tongues 35, 37 of the first and second sheets 10, 20. The tongue 35 of the first sheet 10 may be cut perpendicularly to the tongue 37 of the second sheet 20. There may be two slots or notches 34 residing in the body 31 of the tongue 35 of the first sheet 10. There may also be a plurality of fingers 31*a*, having openings 33 between them. The width of the opening 33 of the tongue 35 may be slightly bigger than the thickness of the second sheet 20 and vice versa, so that a relatively perfect fit can be achieved when inserting the two together. The length (x) of the slots 34 may be slightly shorter than the length (y) of the flanges 32. therefore when the flange 32 is inserted and secured to the slot 34 it will fit tightly and hence avoid the said flange 32 from coming out of the said slot 34. The length (z) of the openings 33 may be configured in such a way that when the flange 32 is inserted in the slot 34 the tongue 35 of the first sheet 10 touches the top surface of the second sheet 20 and the tongue 37 of the second sheet 20 touches the bottom surface of the upper sheet 10.

In order to facilitate inserting and securing the flanges 32 to the slots 34, the openings 33 of the first sheet's tongue 35 may be aligned to that of the second sheet's tongue 37 perpendicular to each other and then pushed all the way through the body 31 so that the flange 32 will intersect with the slot 34 at a 90 degree angle, the flange 32 may then be secured tightly to the slot 34. The openings 33 may have rounded edges in order to help with a smooth insertion. All the tongues 35, 37 of the same pallet may have the same design and configuration respectively, however it will be appreciated that they need not be in the same direction as long as the tongues 35, 37 are substantially perpendicular to each other, and therefore the same description and procedure as above can be applied to form a secure support means 30.

Thus, it will be understood that to erect a pallet from the parts referred to, when the flange 32 is forced through the body 31 of the tongues 35 into slots 34, the slot 34 will catch the flange 32 and body 31 will prevent flange 32 from reversing and thereby securing and complete the "lock-in" process.

The construction of paper pallets can also be made by reversing or exchanging the said first sheet 10 with the second sheet 20 or vice versa. In addition, the support means 30 can also be configured and designed with several different cuts on the parts of the first sheet 10 and the second sheet 20 comprising the tongues 35, 37. For instance two alternative cutting arrangements are shown in FIGS. 4*a*, 4*b* to FIGS. 5*a*, 5*b*, where the arrangement of the tongues 35, 37 can be either opposite or in series with each other.

The said support means 30 are substantially hollow, therefore in order to provide further reinforcement to the present invention, if necessary, a reinforcement core 36 may be place in some or all of the support means 30. The said reinforcement core 36 can be of any suitable shape (i.e. cylindrical, cube block etc.) and can be made of corrugated fibreboard, solid paperboard, multiple layers of paper material wound together either spirally or flat or any other paper material. The size and height of the said reinforcement core 36 may advantageously correspond respectively to the said hollow space inside the said support means 30 so that the said reinforcement core 36 gives extra support to the said pallet so as not to wobble inside the said support means 30. FIG. 6 illustrates the exploded view of the said support means 30 with an example of a reinforcement core 36 placed within.

Referring to FIGS. 7, 8 and 9 there is illustrated an alternative embodiment of the present invention which can also be constructed by having only one "slot in" locking means for each of the said support means 30. Thus in this embodiment each of the support means 30 has only one pair of tongues 35, 37, that is the top tongue 35 cut out from the first sheet 10 which consists of a slot 34 and opening 33, and the bottom tongue 37 cut out from the second sheet 20 which consists of a flange 32 and opening 33. The tongues 35, 37 may be cut perpendicularly to each other so that the flange 32 and the slot 34 will intersect each other at a 90 degree angle. For this alternative embodiment the fastened tongues 35, 37 may be placed inside the said reinforcement core 36 to form the support means 30 as illustrated in FIGS. 7 and 9. The procedure for fastening the flange 32 and the slot 34 is the same as mentioned above in the preferred embodiment.

The invention claimed is:

1. A pallet comprising:

first and second sheets parallel to and spaced apart from one another;

first and second interengagable tongues extending transversely from the first and second sheets and towards the second and first sheets, respectively;

said first and second tongue oriented transversely to one another and having outer edges;

said first and second tongues including first and second slots extending from said outer edges towards the first and second sheets with said first and second slots interengaged so the outer edges of the first and second sheets engage the second and first sheets, respectively;

said first slot including first and second segments, the first segment extending from the outer edge of the first tongue, the second segment spaced apart from a distal end of the first segment, the second segment having a length; and said second tongue having a flange extending into said second slot, said flange sized and positioned to engage the second segment of the first slot so to secure said first and second tongues and the first and second sheets therewith to one another.

2. A pallet according to claim 1 wherein said interengageable tongues comprise a body and a plurality of fingers separated by said slots.

3. A pallet according to claim 2 wherein said fingers are substantially rectangular.

4. A pallet according to claim 1 wherein said slots have flared open ends.

5. A pallet according to claim 1 wherein said first and second interengagable tongues define a support member, and wherein said support member includes pairs of said interengageable first and second tongues defining an open region between said first and second sheets.

6. A pallet according to claim 5 further comprising a reinforcing member disposed within said open region.

7. A pallet according to claim 1 further comprising a reinforcing member positioned between said first and second sheets.

8. A pallet according to claim 7 wherein the reinforcing member is disposed around and encircles said first and second interengageable tongues.

9. A pallet according to claim 1 wherein the sheets and tongues are made from at least one of the following: corrugated fiberboard and solid paperboard.

10. A pallet according to claim 1 further comprising a water resistant coating on at least said sheets.

11. A pallet according to claim 1 wherein said length of said segment is no greater than the flange engaged therein.

* * * * *